US006198452B1

(12) United States Patent
Beheler et al.

(10) Patent No.: US 6,198,452 B1
(45) Date of Patent: Mar. 6, 2001

(54) ANTENNA CONFIGURATION

(75) Inventors: Carl M. Beheler, Richardson; William H. Grona, Dallas, both of TX (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/307,313

(22) Filed: May 7, 1999

(51) Int. Cl.[7] ..... H01Q 3/00

(52) U.S. Cl. ..... 343/757; 343/765; 343/839; 343/882

(58) Field of Search ..... 343/754, 755, 343/757, 758, 761, 781 P, 836, 837, 839, 840, 765, 880, 882; 342/372, 380

(56) References Cited

U.S. PATENT DOCUMENTS 4,251,819 * 2/1981 Vickland ..... 343/882
4,516,128 * 5/1985 Watanabe et al. ..... 343/761
4,598,297 * 7/1986 Hawkins ..... 343/882
4,994,816 * 2/1991 Kondo ..... 343/762
5,419,521 * 5/1995 Matthews ..... 248/278
5,945,961 * 8/1999 Price et al. ..... 343/757

* cited by examiner

*Primary Examiner*—Tho Phan
(74) *Attorney, Agent, or Firm*—Nathan O. Jensen; Kyle Eppele; J. P. O'Shaughnessy

(57) ABSTRACT

A positioner (or gimbal assembly) for a compact antenna assembly is disclosed. The positioner provides accurate pointing of the antenna assembly (typically a narrow beam radio frequency (RF) radiating assembly) mounted on a rapidly moving platform. The positioner is comprised of a first, second, and third axis assemblies which support the antenna assembly and allow rotation of the antenna assembly about first, second, and third axis. The axis assemblies are arranged so the first, second and third axis are non-orthogonal and intersect at the approximate geometric center of the antenna assembly allowing continuous and independent rotation of the antenna assembly about each axis within a confined volume.

20 Claims, 3 Drawing Sheets

ANTENNA CONFIGURATION

BACKGROUND OF THE INVENTION

The present invention generally relates to radio frequency (RF) antennas, and particularly to a positioner or gimbal assembly for an antenna mounted to a platform subject to submarine motion such as a ship, submarine, or the like.

Millimeter-wave RF antennas intended for use aboard ships or submarines, or on similarly moving platforms face extraordinarily severe operating requirements and constraints including limited allowable swept volume, complete hemispherical coverage under significant platform dynamics, very strong/rigid gimbal structure and high radio frequency (RF) performance (e.g., effective isotropic radiated power (EIRP) and gain-to-noise-temperature-ration (G/T)). Because of the severe attenuation of practical, millimeter-wave, high-power transmission line technologies, the need for higher EIRP performance from relatively small diameter apertures has driven placement of the antenna's millimeter-wave RF power amplifier unit as close to the feed input port as possible. The size and weight of such devices, together with the desire for multi-frequency band operation, have led to a strong desire for a positioner that has the ability to accommodate relatively heavy loads on its axis. Thus, the necessity of intersecting gimbal axis driven by the need for minimum swept volume forces normal, 3-axis gimbal configurations using orthogonal axis into geometrical arrangements which significantly decrease the effective antenna aperture in order to withstand the imposed loading requirements.

Accordingly, a goal of the present invention is to provide a positioner for a compact millimeter-wave RF antenna mounted on a rapidly moving platform which provides accurate pointing of a narrow beam radio frequency (RF) radiating assembly to provide complete hemispherical coverage within a confined volume (i.e., a minimum swept volume).

SUMMARY OF THE INVENTION

The present invention is directed to a novel positioner (or gimbal assembly) for compact RF antennas suitable for mounting to platforms subject to submarine motion. The positioner provides accurate pointing of a narrow beam radio frequency (RF) radiating assembly [hereinafter antenna assembly] to provide complete hemispherical coverage under significant platform dynamics. The positioner is comprised of a first axis assembly supporting the antenna assembly, which is configured to rotate the antenna assembly about a first axis. A second axis assembly supports the first axis and antenna assemblies and is configured to rotate the antenna assembly about a second axis. A third axis assembly supports the antenna assembly and first and second axis assemblies, and is configured to rotate the antenna assembly about a third axis. The axis assemblies are arranged so the first, second and third axis are non-orthogonal and intersect at the approximate geometric center of the antenna assembly allowing continuous and independent rotation of the antenna assembly about each axis within a confined volume. This allows the diameter of the radiating aperture (i.e., the antenna's reflector) to be maximized for a given minimum swept area.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DESCRIPTION OF THE PREFERRED EMBODIMENT

Reference will now be made in detail to the presently preferred embodiment of the invention, an example of which is illustrated in the accompanying drawings.

Figure 1:
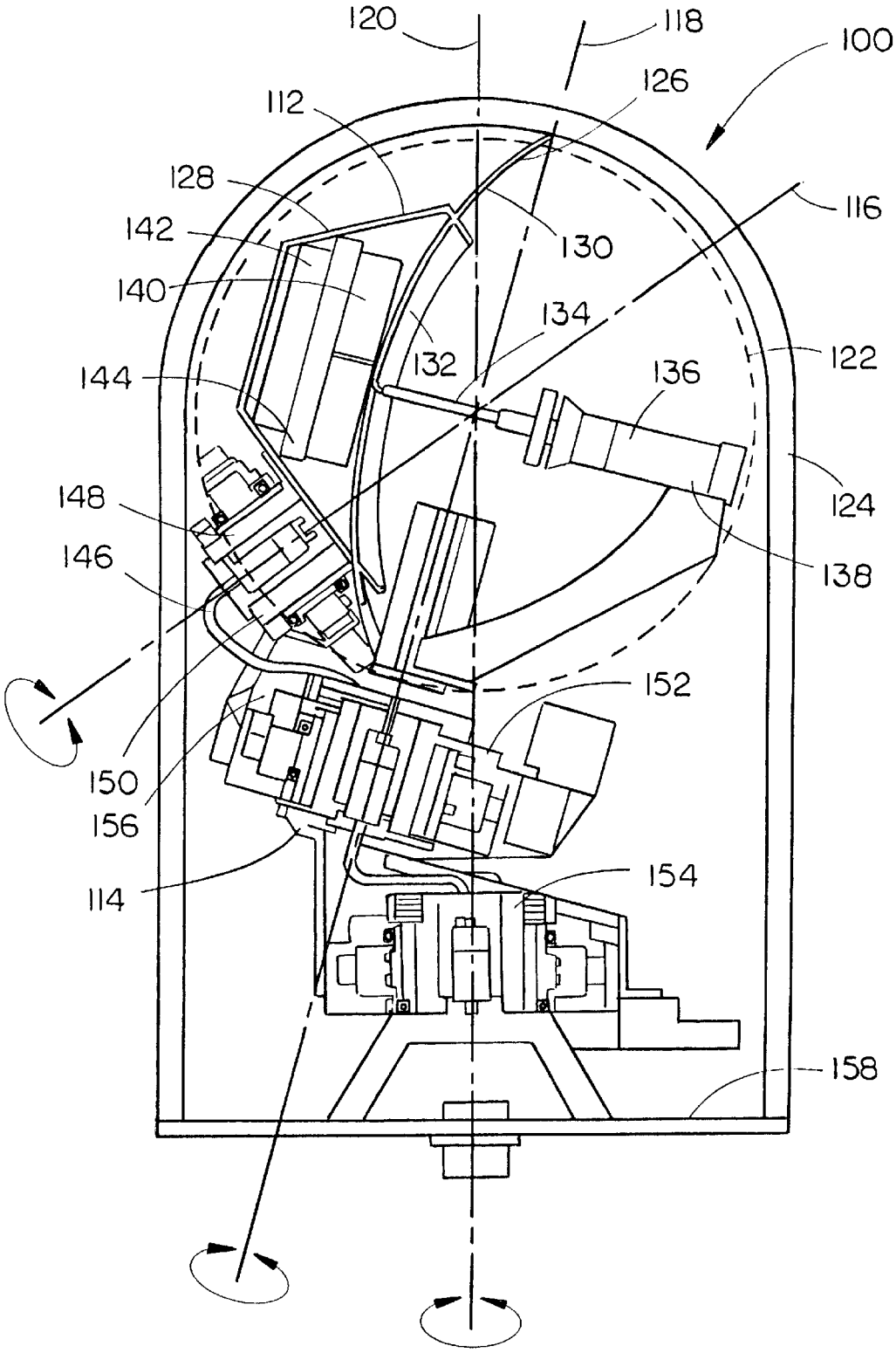
FIG. 1 is a side elevational cross-sectional view of a radio frequency (RF) antenna having a three-axis positioner.

Referring now to FIG. 1, a radio frequency (RF) antenna having a positioner or gimbal assembly in accordance with an exemplary embodiment of the present invention is shown. The antenna 100 is comprised of an antenna assembly 112 rotatably mounted to a three-axis positioner 114. The positioner 114 provides rotation of the antenna assembly 112 independently about any of three non-orthogonal axis 116, 118 & 120 while remaining within the confined hemispherical envelope 122 of a radome 124. This allows the diameter of the radiating aperture (i.e., the antenna's reflector/RF feed assembly 126) to be maximized for a given minimum swept area.

Figure 2:
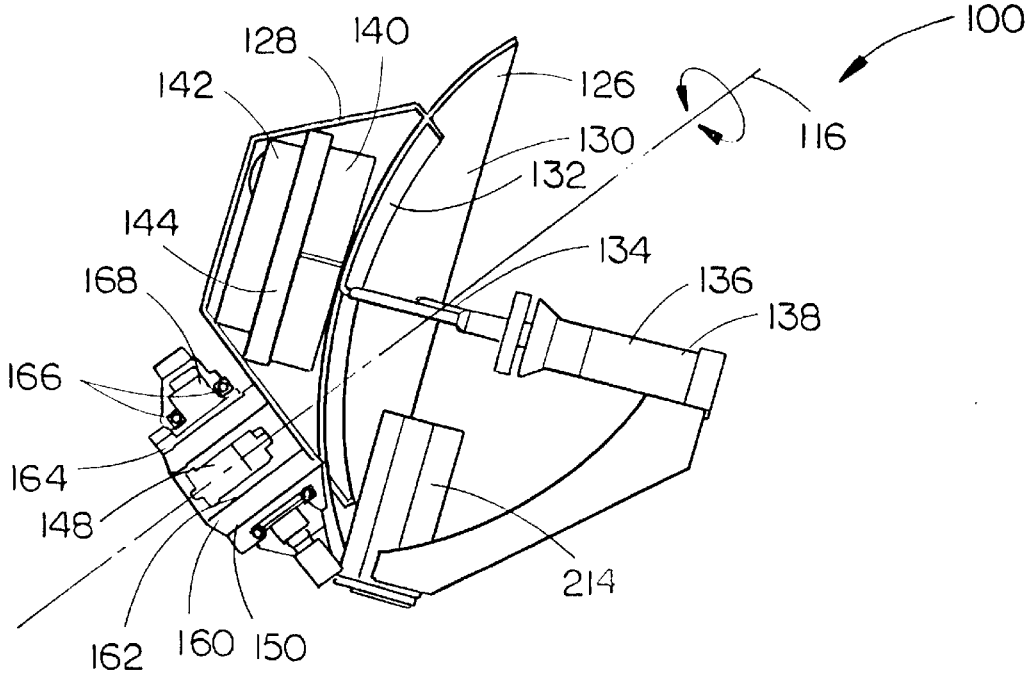
FIG. 2 is a side elevational cross-sectional view of the antenna assembly and first axis assembly of the RF antenna shown in FIG. 1.

Turning now to FIGS. 1 and 2, the antenna assembly 112 is shown. The antenna assembly 112 includes a reflector/RF feed assembly 126 and an RF amplifier enclosure/reflector support structure 128. In the exemplary embodiment shown, wherein the antenna 100 may be utilized aboard a ship or submarine in a satellite communication (SATCOM) system, the reflector/RF feed assembly 126 may include a main reflector 130, an EHF (Elevated High Frequency Antenna) subreflector 132, an EHF feed/polarizer/diplexer package 134, a DSCS (Defense Satellite Communications System) feed/polarizer/diplexer assembly 136, waveguide filters 138, and waveguide extensions (not shown)to connect the EHF and DSCS low noise amplifiers (LNA) 140 and solid state power amplifiers (SSPA) 142.

The RF amplifier enclosure/reflector support structure 128 comprises an air-cooled box structure extending from the rear of the main reflector 130 to mount the reflector/RF feed assembly 126 onto the positioner 114. Preferably, the EHF and DSCS amplifiers (LNA's and SSPA's) 140 & 142 mount to a finned, air-cooled mounting plate 144 within the RF amplifier enclosure/reflector support structure 128. Fans or blowers (not shown) are mounted to opposite sidewalls of the RF amplifier enclosure/reflector support structure 128 to force air through the fins of the mounting plate 144 to cool the components contained therein. Coaxial couplers and cables 146 interconnect components within the RF amplifier enclosure/reflector support structure 128 to a common, dual channel RF rotary joint 148.

The main reflector 130 may be equipped with pads (not shown) on its rear surface to which DC-DC converters (now shown) are mounted. The DC-DC converters receive high voltage, low current power from inboard equipment, and convert it to low voltage, high current power for the SSPA's 142.

The signal inputoutput (I/O) control module (not shown) may be mounted within the RF amplifier enclosure/reflector support structure 128. The I/O control module continuously samples all control and status signals and transmits the signals to a remotely located (e.g., below deck) antenna control unit (ACU) (not shown). The digital output data stream provided by the I/O control module provides all data required by the ACU to accurately point the antenna assembly 112 and control its operation.

Figure 3:
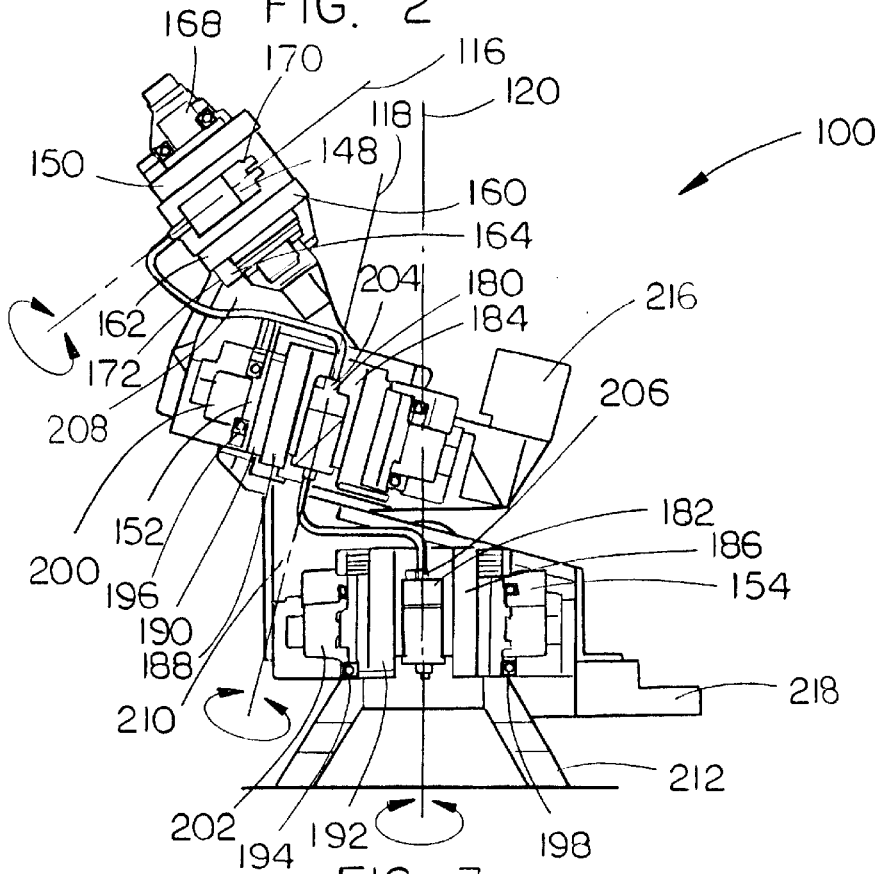
FIG. 3 is a side elevational cross-sectional view of the three-axis positioner shown in FIG. 1 illustrating the second and third axis assemblies.

Referring now to FIGS. 1, 2 and 3, the three-axis positioner 114 is shown. The positioner 114 is comprised of first (or inclined elevation), second (or canted azimuth), and third (or lower azimuth) axis assemblies 150, 152 & 154 which support and rotate the antenna assembly 112 to provide a full range of motion thereto about each of the three axis 116,118 & 120. The first axis assembly 150 is attached to the RF amplifier enclosure/reflector support structure 128 to support and rotate the antenna assembly 112 about the first axis 116. The second axis assembly 152 supports the first axis assembly 150 and the antenna assembly 112. The second axis assembly 152 rotates the antenna assembly 112 (and the first axis assembly 150) about the second axis 118. Similarly, the third axis assembly 154 supports the antenna assembly 112 and first and second axis assemblies 150 & 152, and rotates the antenna assembly 112 (and the first and second axis assemblies 150 & 152) about the third axis 120.

To minimize the swept volume of the positioner 114, the first, second, and third axis assemblies 150,152 & 154 are arranged so the first, second and third axis 116, 118 & 120 are non-orthogonal and intersect at a single point. Preferably, this point is on axis and positioned at the approximate geometric center of the antenna assembly 112. This allows continuous and independent rotation of the antenna assembly 112 about each axis 116,118 & 120 within a confined volume (e.g., within the radome 124).

The arrangement of the first, second, and third axis assemblies 150, 152 & 154 allows a very large diameter radiating aperture for a given radome diameter. For example, within a standard 21.75 inch outside diameter radome 124, the positioner 114 supports a 19.5 inch diameter reflector. Conventional orthogonal positioners, on the other hand, typically allow reflectors having diameters of no more than approximately 16 inches for such a radome 124. Additionally, the positioner 114, because of its configuration, provides a naturally stiff and rigid structure, making higher locked-motor resonance frequencies easier to realize. Further, all three axis assemblies 150,152 & 154 comprise continually rotating structures with no mechanical stops or limits. Thus, no brakes or stow mechanisms are required to lock the first, second or third axis assemblies 150,152 & 154 in place when unpowered.

As can be seen from FIG. 1, the first and second axis assemblies 150 & 152 form a differential mount 156 for the antenna assembly 112. The third axis assembly 154 supports the differential mount 156. Preferably, the third axis assembly 154 resembles a conventional azimuth axis assembly allowing the third axis 120 to be generally vertical with respect to the platform 158.

The first and second axis assemblies 150 & 152 forming the differential mount 156 are preferably inclined approximately 15 degrees with respect to the third axis 120. Because the platform 158 (e.g., the deck of a ship or submarine) on which the antenna 100 is mounted is subject to submarine motion, the second and third axis assemblies 152 & 154 serve to shift the narrow beam radiated by the antenna assembly 112 (i.e., the keyhole) away from the operating zone of the antenna 100 so that tracking is continuous even under worst case platform movement (e.g., in worst case sea conditions).

As shown in FIG. 2, the first axis assembly 150 includes the RF rotary joint 148, a slip ring assembly 160 (comprised of inner and outer slip rings 162 & 164), angular contact bearings 166 (two are shown), a direct current (DC) torque motor 168, and a two-speed resolver (not shown). The slip ring assembly 160 allows unlimited motion of the antenna assembly 112 about the first (inclined elevation) axis 116. Quick disconnect connectors 170 are provided to the RF rotary joint 148 for ease of maintenance.

As shown in FIG. 3, the inner slip ring 162 of the slip ring assembly 160 is preferably attached to the RF amplifier enclosure/reflector support structure 128 to support the antenna assembly 112 while the outer slip ring 164 is housed within the outer driven portion 172 of the second axis assembly 152. The angular contact bearings 166, disposed between the inner and outer slip rings 162 & 164, reduce friction within the slip ring assembly 160 due to rotation of the antenna assembly 112. Preferably, preload of the angular contact bearings 166 is easily adjusted by maintenance personnel.

The DC torque motor 168 rotates the inner and outer slip rings 162 & 164 with respect to each other thereby producing rotation of the antenna assembly 112 about the first axis 116. The resolver provides position loop data for the antenna assembly 112 with respect to the first axis 116 to the ACU (not shown). The ACU in turn controls operation of the DC torque motor 168 to rotate the antenna assembly 112 about the first axis 116 as necessary for continuous tracking by the antenna 100.

As further shown in FIG. 3, the second and third axis assemblies 152 & 154, like the first axis assembly 150, include RF rotary joints 180 & 182, slip ring assemblies 184 & 186 (comprised of inner and outer slip rings 188 & 190 and 192 & 194, respectively), angular contact bearings 196 & 198, DC torque motors 200 & 202, and two-speed resolvers (not shown). Quick disconnect connectors 204 & 206 are provided to the RF rotary joints 180 & 182 for ease of maintenance.

The outer slip ring 190 of the second axis assembly 152 is attached to the assembly's upper transition member 208 which in turn supports the first axis assembly 150 (and the antenna assembly 112). The inner slip ring 188 connects directly to the outer housing of the third axis assembly 154 and rotates within the outer slip ring 190 to provide unlimited motion of the antenna assembly 112 about the second (canted azimuth) axis 118. Similarly, the outer slip ring 194 of the third axis assembly 154 is attached to the lower transition member 210 of the third axis assembly 154. The lower transition member 210 in turn supports the second axis assembly 152 (as well as the first axis assembly 150 and the antenna assembly 112). The inner slip ring 192 connects directly to the lower azimuth riser 212 at the base of the antenna 100 and rotates within the outer slip ring 194 to provide unlimited motion of the antenna assembly 112 about the third (lower azimuth) axis 120.

The DC torque motors 200 & 202 rotate the antenna assembly 112 (and first and second axis assemblies 150 & 152) about the second and third axis 118 & 120, respectively. The resolvers provide position loop data for the antenna assembly 112 with respect to the second and third axis 118 & 120 to the ACU (not shown) so the ACU may control operation of the DC torque motors 200 & 202 to rotate the antenna assembly 112 about the second and third axis 118 & 120 as necessary for proper tracking by the antenna 100.

Preferably, the first, second, and third axis assemblies 150,152 & 154 employ identical rotary joints 148,180 & 182, slip ring assemblies 160,184 & 186, and resolvers. This commonality of parts and design among the first, second and third axis assemblies 150,152 & 154 provides advantages such as reduced cost, simpler maintenance, and smaller inventory of spare parts. The DC torque motors 200 & 202 and angular contact bearings 196 & 198 of the second and third axis assemblies 152 & 154 may be slightly larger than their counterparts within the first axis assembly 150 due to slightly greater drive requirements.

The positioner 114 must be balanced precisely within the confined space of the radome 124. This balancing is preferably accomplished by providing each axis assembly 150, 152 & 154 with a counterweight 214, 216 & 218 to balance its mass during rotation. Each counterweight 214, 216 & 218 is fabricated from a dense material such as depleted uranium or a tungsten alloy (such alloys have a density slightly less than that of depleted uranium). In the exemplary embodiment shown in FIGS. 2 and 3, the counterweight 214 of the first axis assembly 150 comprises a ring sector extending from the lower rim of the main reflector 130. The counterweight 216 of the second axis assembly 152 is attached to the assembly's outer housing. Preferably, the position of the counterweight 216 may be adjusted radially to obtain precise balancing of the second axis assembly 152. The counterweight 218 of the third axis assembly 154 swings in a space beneath the base heat exchanger (not shown) rather than extending radially from the outer, movable portion of the third axis assembly 154.

Figure 4:
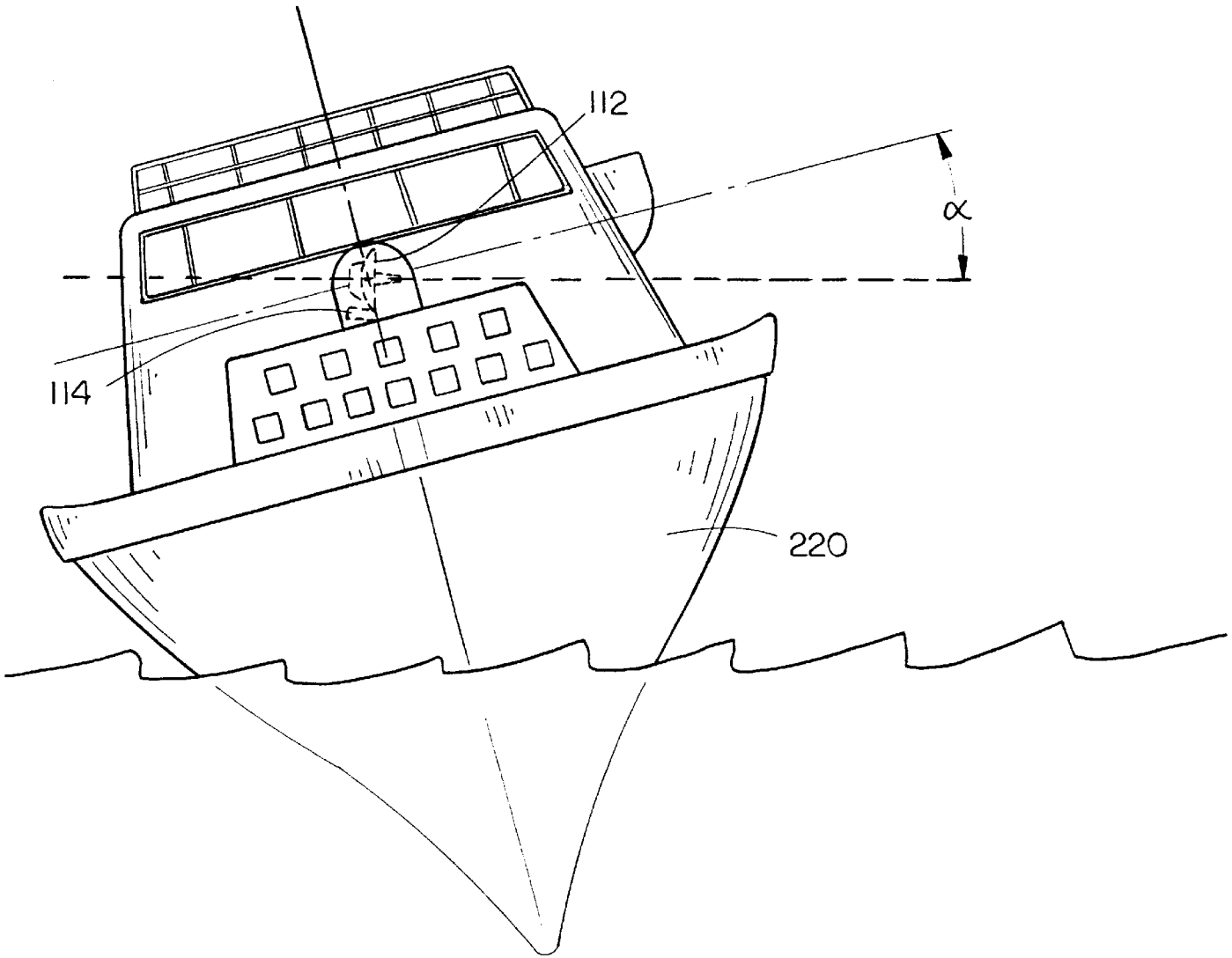
FIG. 4 is a bow elevational view of a ship having an RF antenna in accordance with the present invention.

Referring now to FIG. 4, mounting of the RF antenna aboard a ship is shown. The orientation of the axis 116,118 & 120 allows a large amount of lookdown (i.e., negative deck-frame elevation angle ($\alpha$)) by the antenna assembly 112 with negligible blockage of the radiation aperture by the positioner 114. Preferably, negative deck-frame angles ($\alpha$) of up to approximately 15 degrees are possible. This allows full hemispheric RF coverage even under worst case platform inclination (i.e., extreme listing of ship 220 due rough seas or hard maneuver). In contrast, conventional axis arrangements suffer severe blockage at such angles when swept volume is minimized.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A positioner for mounting an antenna assembly on a moving platform, comprising:

a first axis assembly supporting the antenna assembly, said first axis assembly configured to rotate the antenna assembly about a first axis;

a second axis assembly supporting the first axis assembly and antenna assembly, said second axis assembly configured to rotate the antenna assembly about a second axis; and a third axis assembly supporting the antenna assembly and first and second axis assemblies, said third axis assembly configured to rotate the antenna assembly about a third axis;

wherein the first, second and third axes are non-orthogonal and intersect at the approximate geometric center of the antenna assembly allowing continuous and independent rotation of the antenna assembly about each axis within a confined volume.

2. The positioner of claim 1, wherein each of said first, second and third axis assemblies comprises a rotary joint.

3. The positioner of claim 2, wherein said rotary joint further comprises an angular contact bearing.

4. The positioner of claim 2, wherein each of said first, second and third axis assemblies further comprise a torque motor.

5. The positioner of claim 2, wherein each of said first, second and third axis assemblies further comprise a resolver.

6. The positioner of claim 2, wherein each of said first, second and third axis assemblies further comprise a counterweight.

7. The positioner of claim 1, wherein said first, second and third axis assemblies allow the antenna assembly to be pointed at an angle below a surface of the moving platform. surface of the moving platform.

8. The positioner of claim 7, wherein said angle is between 0 and approximately 15 degrees.

9. The positioner of claim 1, wherein said first and second axis assemblies form a differential mount for the antenna assembly, and wherein the differential mount is inclined at an angle with respect to the third axis.

10. The positioner of claim 9, wherein said angle is between 0 and approximately 15 degrees.

11. A radio frequency antenna configured to be mounted on a moving platform, comprising:

an antenna assembly; and a positioner supporting said antenna assembly; said positioner including:

a first axis assembly supporting said antenna assembly, said first axis assembly configured to rotate said antenna assembly about a first axis;

a second axis assembly supporting said first axis assembly and said antenna assembly, said second axis assembly configured to rotate said antenna assembly about a second axis; and a third axis assembly supporting said antenna assembly and said first and second axis assemblies, said third axis assembly configured to rotate said antenna assembly about a third axis, wherein the first, second and third axis are non-orthogonal and intersect at the approximate geometric center of said antenna assembly allowing continuous and independent rotation of the antenna about each axis within a confined volume.

12. The radio frequency antenna of claim 11, wherein each of said first, second and third axis assemblies comprises a rotary joint.

13. The radio frequency antenna of claim 12, wherein said rotary joint further comprises an angular contact bearing.

14. The radio frequency antenna of claim 12, wherein each of said first, second and third axis assemblies further comprise a torque motor and a resolver.

15. The radio frequency antenna of claim 12, wherein each of said first, second and third axis assemblies further comprise a counterweight.

16. The radio frequency antenna of claim 11, wherein said first, second and third axis assemblies allow the antenna assembly to be pointed at an angle below a surface of the moving platform.

17. The radio frequency antenna of claim 16, wherein said angle is between 0 and approximately 15 degrees.

18. The radio frequency antenna of claim 11, wherein said first and second axis assemblies form a differential mount for the antenna assembly, and wherein the differential mount is inclined at an angle with respect to the third axis.

19. The radio frequency antenna of claim 18, wherein said angle is between 0 and approximately 15 degrees.

20. A positioner for mounting an antenna assembly on a moving platform, comprising:

means, supporting the antenna assembly, for rotating the antenna assembly about a first axis;

means, supporting the first rotating means and antenna assembly, for rotating the antenna assembly about a second axis; and means, supporting the antenna assembly and first and second rotating means, for rotating the antenna assembly about a third axis, wherein the first, second and third axis are non-orthogonal and intersect at the approximate geometric center of the antenna assembly allowing continuous and independent rotation of the antenna assembly about each axis within a confined volume.

* * * * *